United States Patent [19]

Griffith

[11] Patent Number: 4,596,230

[45] Date of Patent: Jun. 24, 1986

[54] FOOTBALL THROWING MACHINE

[76] Inventor: Lawrence L. Griffith, 4720 Nambe Dr., Las Vegas, Nev. 89121

[21] Appl. No.: 668,486

[22] Filed: Nov. 5, 1984

[51] Int. Cl.[4] ..... A63B 69/40

[52] U.S. Cl. ..... 124/78; 124/50; 124/82; 273/55 R

[58] Field of Search ..... 124/78, 45–50, 124/6, 82; 273/55 R

[56] References Cited

U.S. PATENT DOCUMENTS

| | | | |
|---|---|---|---|
| 2,310,746 | 2/1943 | Parker et al. | 124/48 X |
| 4,026,261 | 5/1977 | Paulson et al. | 124/78 |
| 4,460,173 | 7/1984 | Dumas | 124/50 X |

FOREIGN PATENT DOCUMENTS

| | | | |
|---|---|---|---|
| 45428 | 4/1977 | Japan | 124/78 |

*Primary Examiner*—Paul E. Shapiro

*Attorney, Agent, or Firm*—Knobbe, Martens, Olson & Bear

[57] ABSTRACT

A machine projects footballs with varying degrees and directions of spin about either the longitudinal axis, as in a pass, or the transverse axis, as when kicked. The ball is projected by two juxtaposed wheels rotating in opposite directions. The wheels are spaced apart sufficiently to allow passage of the football without permanently damaging the ball, yet close enough together to impart velocity to the football. The football can be projected with a variable amount of spin by varying the relative orientation of the two projecting wheels. The footballs are fed into the projecting wheels by a reciprocating longitudinal plunger having an end attachment which is altered to conform to either the pass or kick orientation of the football. Rotating guide members maintain the football orientation as it is fed into the projecting wheels. A positioning chute orients the football in a vertical, kick position as it is fed into the reciprocating plunger and then into the projecting wheels. In order to orient the football into a pass position, an orientation mechanism contacts the football to reorient it into a horizontal or pass position. A rotating turret, capable of holding several footballs, is located above the chute so that balls can be sequentially fed into the chute and, in turn, into the reciprocating plunger and projecting wheels. A timing mechanism coordinates the rotation of the turret, the release of the ball from the chute, and the plunger reciprocation.

7 Claims, 16 Drawing Figures

Fig. 2
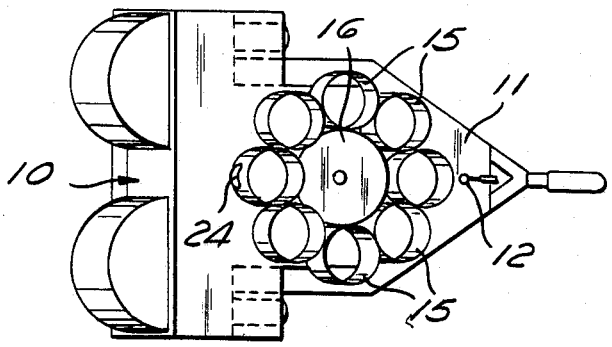
Fig. 3
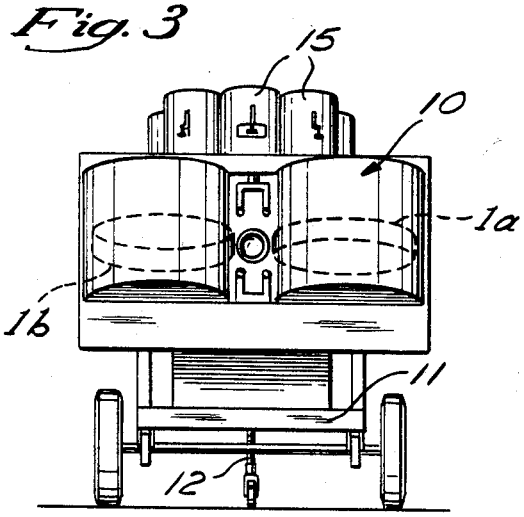
Fig. 1
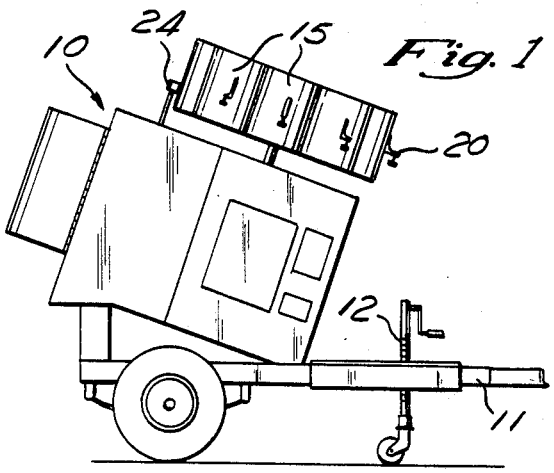
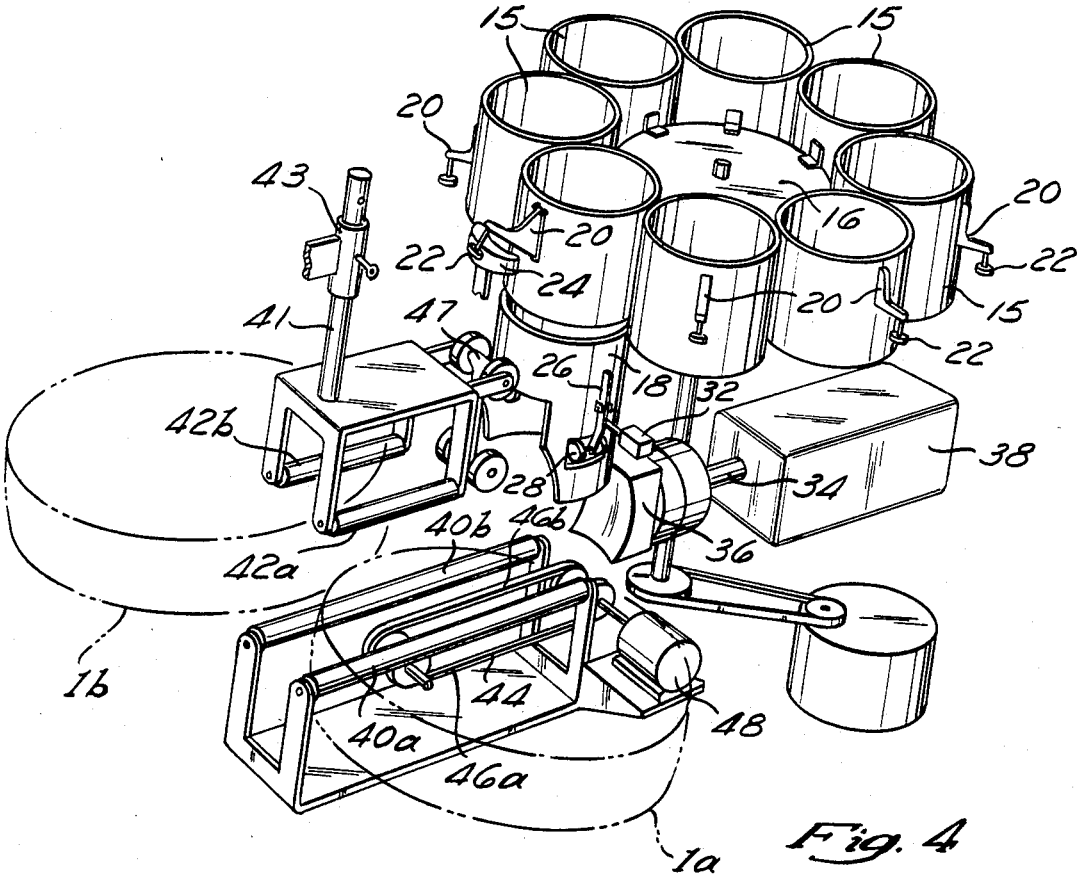
Fig. 4

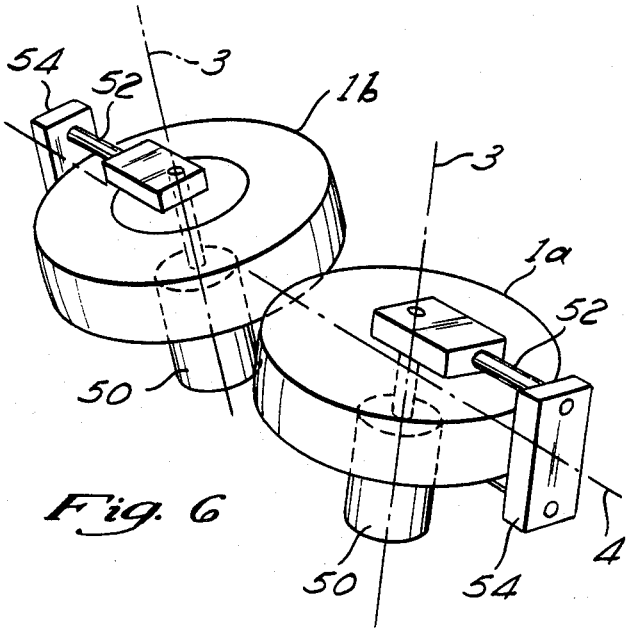
Fig. 6
Fig. 5
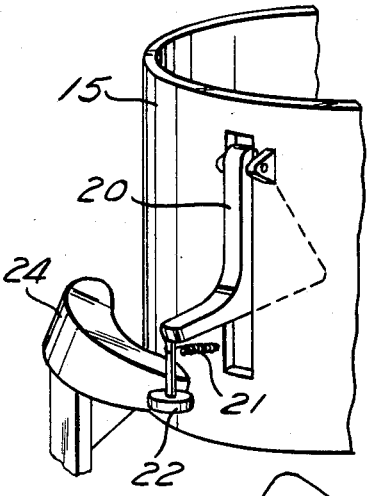
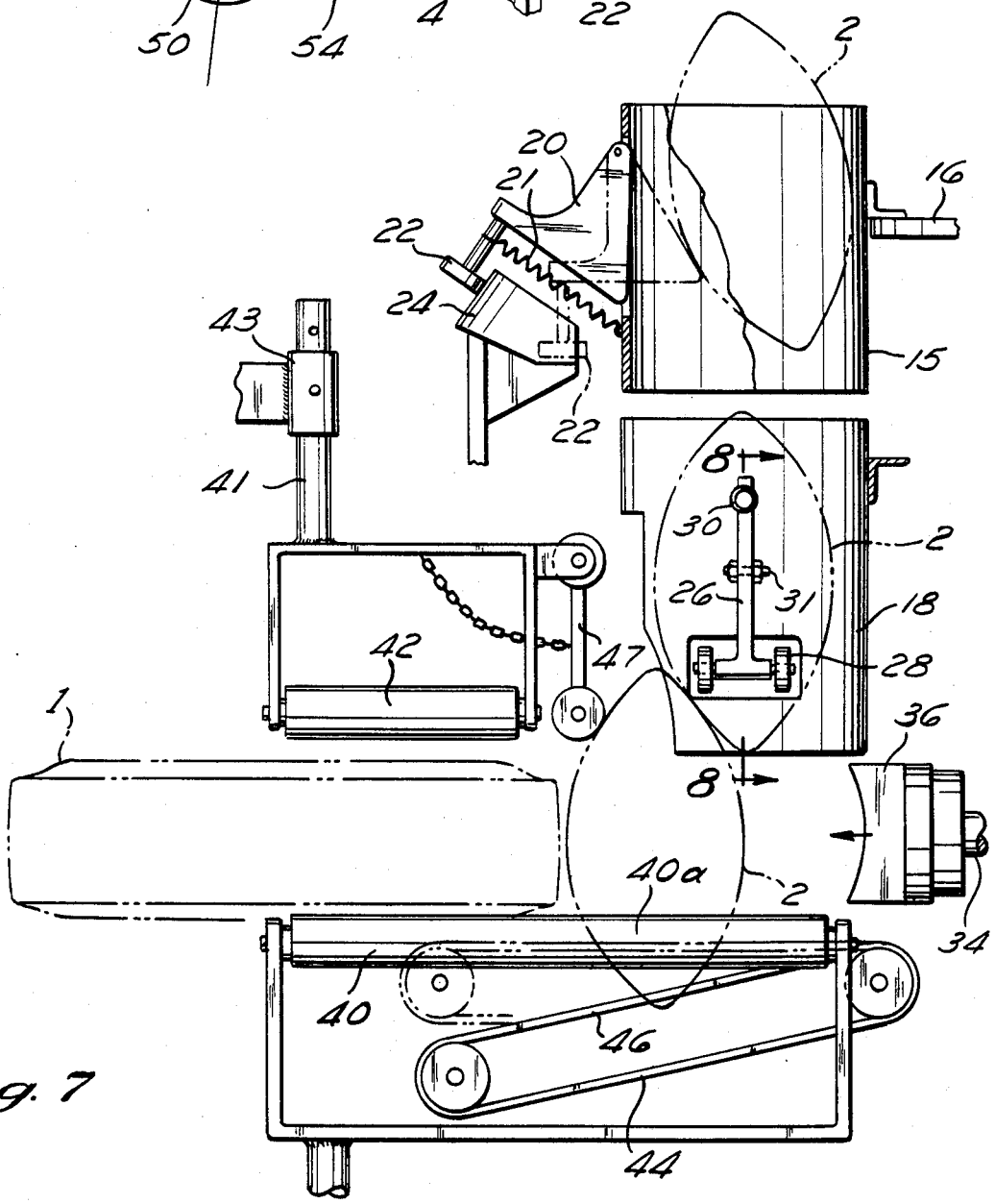
Fig. 7

Fig. 13
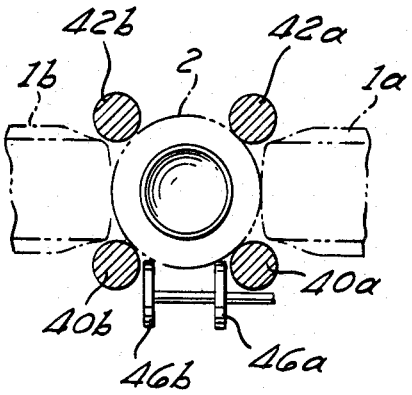
Fig. 12
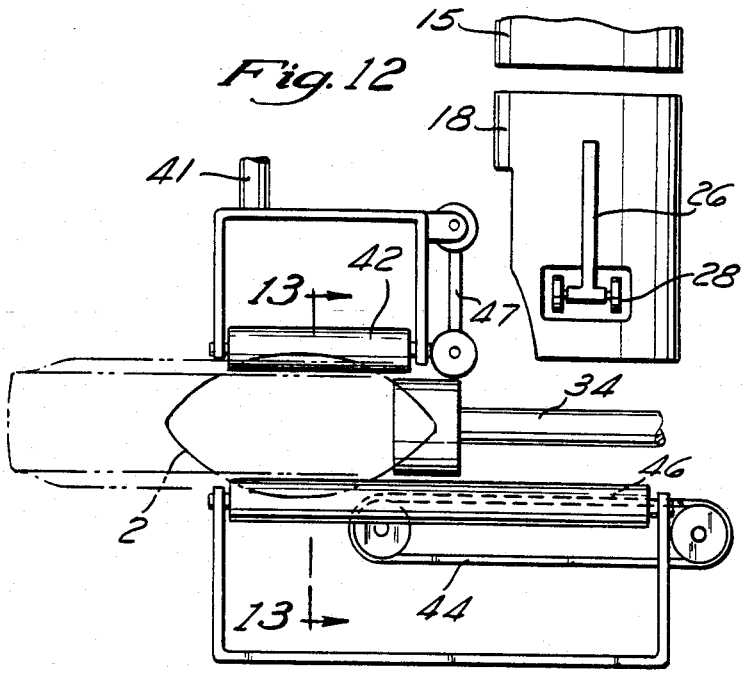
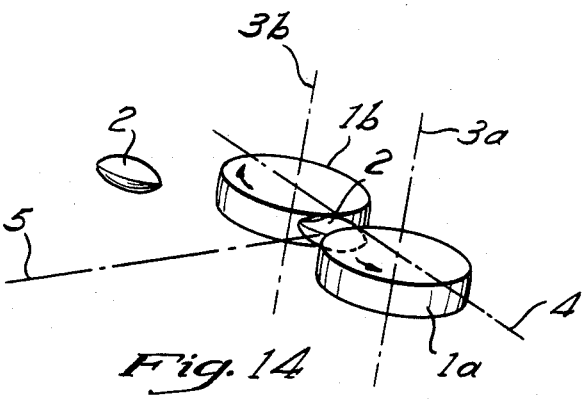
Fig. 14
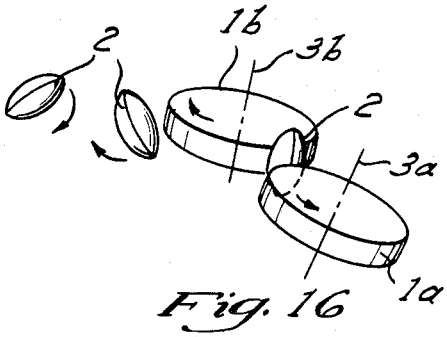
Fig. 16
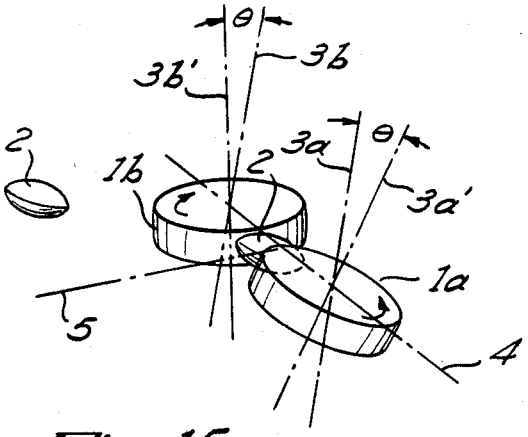
Fig. 15

FOOTBALL THROWING MACHINE

BACKGROUND OF THE INVENTION

This invention is useful in training for the sport of football. Integral parts of football as a sport, are the kicking and passing of the football. Presently, the only way by which a receiver can practice catching a pass or kick is to have another person throw or kick the ball to him. Given the vagaries of human coordination, the passes are inconsistently thrown and the kicks are of variable spin, distance, heights and velocities. These inconsistencies make it difficult for receiver to practice catching certain passes or kicks.

Another disadvantage in practicing with a passer or kicker is that the passer's arm may fatigue, or the kicker's leg may hurt after prolonged practice. Receivers need to practice catching the football without relying upon the vagaries and frailties of a passer or kicker.

A final disadvantage is that in preparing for games, the opposing team may have a kicker with known propensities. Having the kicking receivers practice catching footballs as though they were kicked in the same style as the opposing kicker is desirable. Oftentimes, however, finding someone who can occasionally, or even consistently, project the football in the manner of the opposing kicker is difficult. As shown above, a need exists for being able to consistently project a football with the desired combination of spin, velocity, distance, and height. Eliminating the need for an extra person to pass the football is also desirable.

SUMMARY OF THE INVENTION

This invention is a device which projects footballs into space with variable, yet controllable degrees and directions of spin, velocity and distance. The football is projected by feeding it between two juxtaposed, counter-rotating wheels having sufficient space between the wheels to allow passage of the football with deformation, but without permanent damage. The wheels are typically of standard pneumatic construction as found on cars and trailers.

To simulate a pass, the football is fed between the wheels in a horizontal position with its longitudinal axis oriented towards the direction of projection. The football is projected in a vertical plane passing between the two projecting wheels. The amount of spin can be regulated by varying the amount of skew between the wheels' axes of rotation. A flat pass with no spin is obtained by having the wheels' axes of rotation being substantially parallel. A left or right spiral pass can be obtained by skewing the wheels' axes of rotation in the plane parallel to the plane in which the football is projected. Alternately phrased, each wheel's plane of rotation can be rotated about an axis joining the center of each wheel, resulting in a non planar location of the projecting wheels. A wobble or spin can also be imparted to the football by rotating the two wheels at different velocities.

The football is projected in a kick mode by feeding the ball between the wheels in an upright position with the ball's longitudinal axis vertically oriented. The amount of spin imparted to the football can be regulated by again varying the angle by which the wheels' axes of rotation are skewed.

The velocity with which the football is projected can be regulated by varying the rotational velocity of each wheel. Alternately, if the football is fed between the wheels while the wheels are not rotating, varying the acceleration rate of each wheel can be used to control the velocity, wobble, and spin which is imparted to the football as it is projected.

The height and distance with which the football is projected can be varied by regulating the projection velocity and by varying the orientation of the entire assembly so that the football is projected at a varying angle with respect to the horizontal, or ground. Since the assembly is typically mounted on a mobile trailer, raising or lowering one end of the trailer will have the effect of uniformly tilting the projecting wheels and thereby varying the angle of projection and the maximum height obtained during the football's trajectory. Lateral variations in directions are obtained by pointing the trailer as desired.

The trajectory and spin with which the football is projected is highly repetitive. Thus, a kick or pass having desired characteristics can be repeated consistently in order to allow football receivers to practice catching a desired type of pass or kick.

A controlled automatic feed mechanism allows a number of footballs to be projected seriatim. A rotating turret is mounted on top of the mechanism. The turret holds several containers or cylinders in which footballs can be placed in a vertical orientation. A mechanism rotates the turret containers over a chute; a cam-actuated mechanism releases the football into the chute.

The chute contains several holding arms which help position the football for release into a reciprocating plunger. Solenoids actuate the holding arms in order to time the release of the football into a reciprocating plunger.

The reciprocating plunger is a linearly reciprocating device which shoves the football into the projecting wheels for projection. A rack and gear drive, a reciprocating ball screw, or a high-speed electrolinear actuator can be used to drive the reciprocating plunger.

A cup which conforms to the orientation of the football is placed on the end of the reciprocating plunger. If the football is to be projected in a kick position, a cup conforming to a vertical orientation of the football is used. If projected in a horizontal, pass position, a cup conforming to the conical end of the football is used. A cup having both shapes superimposed, and thus capable of conforming to both orientations could also be used.

The football is dropped into the path of the reciprocating plunger in a kick position with the longitudinal axis of the football vertically oriented. A rotating belt assembly which contacts the projecting nose of the vertically-oriented football reorientates the football into a pass position with the longitudinal axis horizontally oriented. The belt assembly is pivoted out of the way when the horizontally-oriented pass mode is not desired.

Upper and lower roller guides help maintain the orientation of the football as the reciprocating plunger feeds the football into the projecting wheels in a pass position. Lower guides suffice when the kick position is used. The guides are especially needed as the football contacts the projecting wheels in a pass position since the football tends to twist or cant before being fully grasped by the projecting wheels.

After feeding the ball into the projecting wheels, the plunger is withdrawn so that another football can be fed into the plunger path. A timing mechanism coordinates the turret rotation, the release of the football from the chute, and in turn, the actuation of the reciprocating plunger.

BRIEF DESCRIPTION OF THE DRAWINGS

FIG. 1 is a side view of the machine of the invention mounted on a trailer;

FIG. 2 is a top view of the machine of FIG. 1;

FIG. 3 is a front view of the machine of FIG. 1;

FIG. 4 is a perspective view showing the components of the feed mechanism;

FIG. 5 is a perspective view of the cam release mechanism on the containers in the feed turret;

FIG. 6 is a perspective view of the projecting wheels, their mountings, and motor drives;

FIG. 7 is a side view of the overall feed mechanism and projecting wheels;

FIG. 12 shows a football being fed into the projecting wheels in a pass mode;

FIG. 13 is a sectional view on line 13—13 from FIG. 12;

FIG. 14 is a perspective view of a football being projected in a no spin mode;

FIG. 15 is a perspective view of a football being projected in a pass mode with right-hand spin;

FIG. 16 is a perspective view of a football being projected in a kick mode.

DETAILED DESCRIPTION OF THE PREFERRED EMBODIMENT

Figure 8:
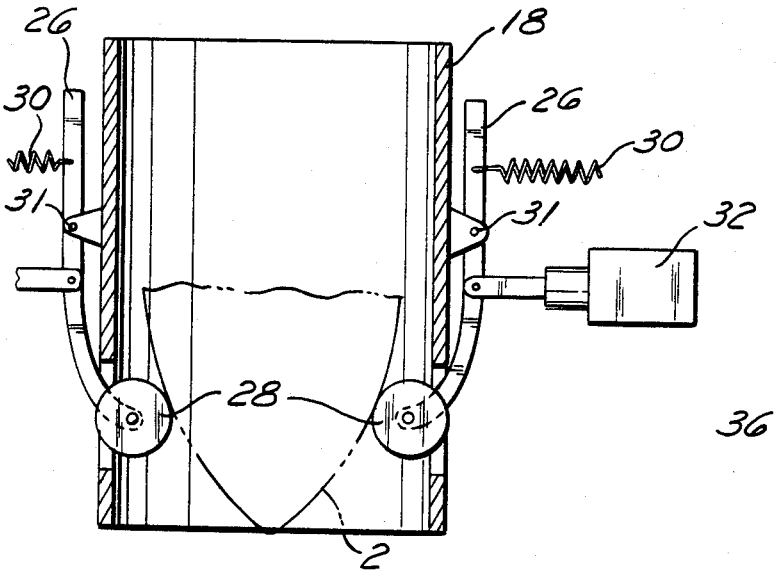
FIG. 8 is a sectional view of the chute on line 8—8 of FIG. 7.

Referring to FIG. 14, there is shown two projecting wheels, 1*a* and 1*b* and football 2. The coplanar wheels 1 are juxtaposed, being spaced apart sufficiently to allow passage of football 2 without permanent deformation or damage. The wheels rotate in opposite directions about axes of rotation 3*a* and 3*b*. As the football 2 passes between the rotating projecting wheels 1, the football is compressed and a velocity is imparted to it by the wheels. The trajectory of the projected football 2 lies in a vertical plane along a line 5 perpendicular to a line 4 joining the centers of the wheels 1.

If the axes of rotation 3 are substantially parallel then the projecting wheels 1 lie in substantially the same plane and the football 2 is projected in a no-spin condition. Alternately phrased, if the wheels' planes of rotation coincide, no spin is imparted to the football 2.

A controlled amount of spin or wobble can be imparted to the football 2 by skewing the axes of rotation 3. The axes of rotation 3 are tilted in vertical planes parallel to the plane of projection as shown in FIG. 15. Tilting each axis of rotation 3*a*′ and 3*b*′ an equal amount R, but in opposite directions, will impart a uniform spin to the football 2. As shown in FIG. 15, the football can have a right-hand spiral spin. Reversing the tilt of both axes of rotation 3, from that shown in FIG. 15, produces a left-hand spiral spin. Alternately phrased, if the wheels' plane of rotation do not coincide, but are rotated about a line 4 joining the centers of the wheels 1, then rotation is imparted to the football 2. If only one axis of rotation 3 is tilted, or if both axes of rotation are not tilted substantially the same amount, then a wobble is imparted to the football 2.

In the above discussions, the football 2 entered and was projected by the projecting wheels 1 with the football in a substantially horizontal position. The football can also enter the projecting wheels 1 in a vertical or kick orientation as is shown in FIG. 16. When the longitudinal axis of the football 2 is vertically oriented, the football is projected as though it had been kicked. The amount of spin and wobble can again be controllably varied by adjusting the amount by which the axes of rotation 3 are tilted relative to one another as previously described.

The projecting wheels 1 are preferably rotating at the time the football 2 is fed into the projecting wheels. It is possible, however, to accelerate the projecting wheels 1 from a rest position once the football 2 has been inserted between the projecting wheels. Varying the net rotational velocity or acceleration of the projecting wheels 1 regulates the velocity with which the football 2 is projected. The spin or wobble of the football 2 can also be regulated by varying the velocity or acceleration of each projecting wheel 1.

The trajectory angle with which the football 2 is projected from the projecting wheel 1 can be varied by uniformly tilting the axes of rotation 3 with respect to the horizontal plane. In the preferred mode, however, the projecting mechanism 10 can be mounted upon a trailer 11 as is shown in FIGS. 1, 2 and 3. The angle of trajectory can then be varied by jack screw 12 which raises or lowers the tongue of the trailer 11, thereby tilting the projecting mechanism 10. Yet another variation would allow the projecting mechanism 10 to be tilted relative to the trailer 11.

The direction of the projected football 2 in the horizontal plane can be varied merely by reorienting the trailer 11. Alternately, the projecting mechanism 10 could be oriented with respect to the trailer 11 to vary the horizontal projection direction.

Referring to FIG. 4, there is shown a pictorial view of the mechanism which feeds the footballs into the projecting wheels 1. Several cylinders or containers 15 are mounted onto a rotating feed turret 16. A football 2 is inserted into each container 15 with the football having its longitudinal axis vertically oriented.

As is shown in FIGS. 5 and 7, a spring 21, preloads retainer arm 20 so that it holds the football 2 in container 15. The retaining arm 20 has a cam follower 22 mounted thereon. As the feed turret 16 rotates the container 15 over the chute 18, the cam follower 22 rides over the stationary cam 24 which causes the retaining arm 20 to pivot out of the way of football 2, thereby allowing the football to drop into chute 18.

Referring to FIG. 8, the football 2 is held in chute 18 by holding arm 26. Holding arms 26 have rollers 28 on one end which symmetrically contact the football 2 in order to orient and position the football as well as to insure a smooth release from the chute 18. The rollers 28 are held into contact with the football 2 by spring 30 which is attached to holding arm 26 above pivot point 31. A solenoid 32 is attached to each holding arm 26 below the pivot point 31 so that the solenoid can pivot the rollers 28 out of contact with the football 2 thereby releasing the football from chute 18. The position of the spring 30 and the solenoid 32 on the holding arm 26 need not be in the orientation shown in FIG. 8, so long as the spring exerts sufficient force on the holding arm to maintain the football 2 in position in the chute 18, yet the solenoid 32 exerts sufficient force to overcome the spring force and thereby release the football from the chute. The rollers provide a low friction guide for the football 2, but this guide could be suitably provided for by other low friction devices such as plastic coated projections.

Figure 9:
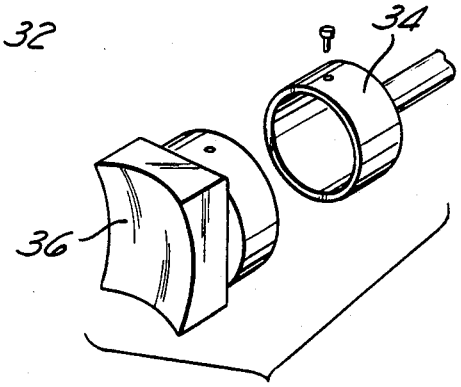
FIG. 9 is a perspective view of the end cup on the reciprocating plunger.
Figure 10:
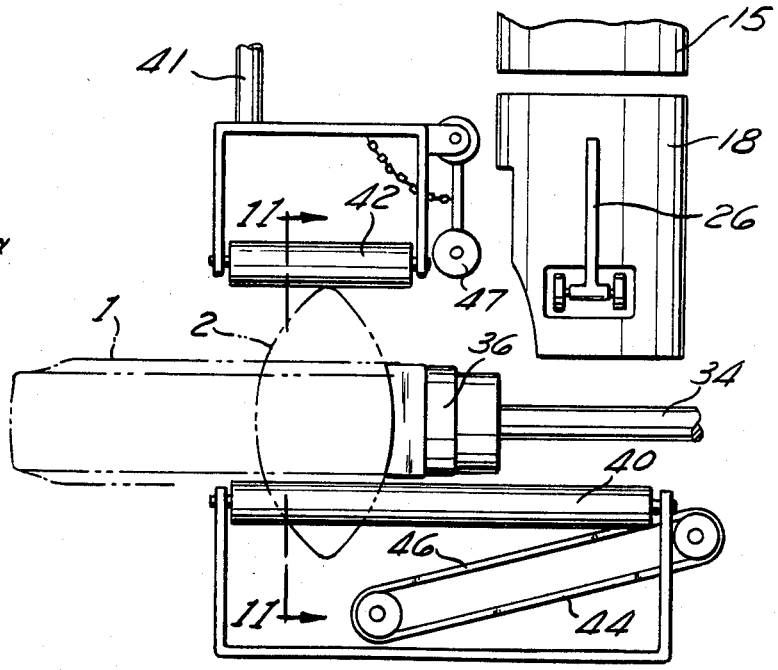
FIG. 10 is a side view showing a football being fed into the projecting wheels in a kick mode.

After the football 2 is released from the chute 18 it drops into the path of reciprocating plunger 34 which in turn shoves the football into the space between the projecting wheels 1 whereby the football is projected into space. Referring to FIG. 9, end cap 36 is attached on the end of reciprocating plunger 34 and has a shape which conforms to the shape of the football 2 when the football is in the proper orientation to be fed into the projecting wheels 1. Thus, as shown in FIG. 10, end cap 36 conforms to the side of the football when the football is projected in a kick position, but as shown in FIG. 12, is changed to conform to the conical end of the football when the football is projected in a pass position. It is possible, however, to superimpose both shapes onto the same end cap 36 so that the end cap need not be physically changed when changing from a pass to a kick mode, or vice versa.

The reciprocating plunger 34 is a linearly reciprocating device driven by mechanism 38 as shown in FIG. 4. The reciprocating plunger drive mechanism 38 can consist of several commercially available mechanisms such as a rack and gear arrangement, a high speed electrolinear actuator, or a linearly reciprocating ball screw.

A lower set of guide rollers 40*a* and 40*b* support the football 2 in either a vertical or horizontal position while the reciprocating plunger 34 pushes the football into the projecting wheels 1. An upper set of guide rollers 42*a* and 42*b* is lowered into position when the football 2 is projected in a pass mode. The lower and upper guide rollers, 40 and 42 respectively, prevent the football from "jumping out" of the space between the projecting wheels while the football is being projected.

Figure 11:
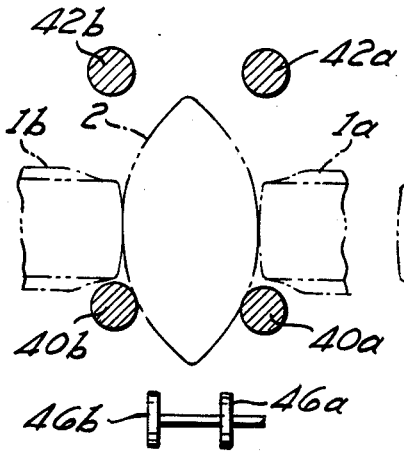
FIG. 11 is a sectional view on line 11—11 from FIG. 10.

When the football 2 is projected in a pass position, it must be reoriented from the vertical position in which it is released from the chute 18, into a horizontal position. This reorientation is achieved by a positioner belt assembly 44 which is pivoted into position when the pass mode is desired. The positioner belt assembly 44 comprises two juxtaposed belts 46*a* and 46*b* driven by a motor 48 as is shown in FIGS. 4 and 7. As shown in FIGS. 11 and 12, the belts straddle the oblong end of the football 2 in order to move the bottom of the football forward, thereby laying it in a horizontal position. The positioner belt assembly 44 is pivoted out of position so that the belts 46 do not contact the football 2 when the football is to be projected in a kick position, as shown in FIGS. 10 and 11.

To prevent a football 2 from turning up at the front when it is rotated to the horizontal position, a hinged guide assembly 46, as in FIG. 7, is located at the end of the frame which supports the upper guide rollers 42. This hinged guide assembly 46 holds the front of the football 2 down in a horizontal position as the belts 46 slip lightly on the under side of the football until the reciprocating plunger mechanism 34 comes forward and the end cup 36 pushes any football forward off of the belts, onto the lower guide rollers 40, and into projecting wheels 1.

The lower and upper guide rollers 40 and 42 respectively, rotate about their longitudinal axes in order to minimize damage or scraping of the football 2 as it is spun by the projecting wheels 1. The upper guide rollers 42 are raised on rod 41 and held by collar 43 so they do not contact the football 2 when the football is projected in a kick condition. The hinged guide assembly 46, which is mounted onto the frame supporting the upper guide rollers 42, comprises two low friction wheels or similar low friction projections which straddle the oblate spheroid football 2 in a symmetrical manner to minimize canting of the football 2 as it is reoriented into the pass position. As the football 2 is pushed forward into the projecting wheels 1 by the reciprocating plunger 34, the hinged guide assembly 46 pivots about one end in order to allow the football to pass without inhibiting its travel.

The projecting wheels 1 are driven by separate, 90 volt DC motors 50, about axes 3 as is shown in FIG. 6. The projecting wheels 1 are each separately mounted on adjustable arms 52 which allow adjustment of the space between the two juxtaposed projecting wheels. The adjustable arms 52 are in turn mounted on a rotational mount 54 which also allows rotation of each wheel 1 about axis 4 which passes through the center of both wheels. Rotational mount 54 attaches to the frame or support of the projecting mechanism 10. This latter rotational adjustment enables a spin to be imparted to the football 2 as previously described. The projecting wheels 1 are of standard pneumatic construction as is typically found on automobile or trailer tires. Various materials or wheel constructions could be used to accelerate and project the football 2, the main criterion being that the wheel material have a high enough coefficient of friction to "grasp" the football, and that the wheel be sufficiently resilient to project the football without damaging it.

As will be apparent to one skilled in the art, there are many variations on the various components of this invention which can be made without detracting from the substance of the invention. While the preferred embodiment is phrased in terms of projecting a football, this invention is equally useful for imparting a design amount of spin and velocity to any object, whether it be spherical, oblong, or an oblate spheroid.

I claim:

1. An apparatus for projecting non-spherical objects comprising:

a feed turret having plural containers, each container having a first retaining mechanism for releasably retaining an object in the container, the mechanism comprising a lever which is resiliently urged against the object, the lever being in connection with a cam follower which follows a cam to controllably release the object;

a chute for receiving the object when the first retaining mechanism releases the object so that it falls into the chute, the chute being located below the containers such that the turret can rotate each container adjacent the chute, each chute having a second retaining mechanism for controllably releasing the object, the mechanism comprising at least one holding arm which is resiliently urged against the object, the mechanism further comprising means for controllably retracting the holding arm to release the object, and at least one set of low friction guides on the holding arm to orient the object and facilitate its release from the chute;

a linearly reciprocating plunger for transporting the object to a projecting device when the object is released from the chute, the plunger being located below and adjacent to the chute, the plunger having a positioner which conforms to the shape of that portion of the object in contact with the positioner when the object is correctly positioned for projection;

at least one set of low friction guides for positioning the object as it is fed into the projection device, the guides comprising a frame supporting at least two rollers which provide a low friction contact with the object so as to position the object, yet allow rotation of the object;

the projecting device projects the object and comprises at least onepair of juxtaposed, counterrotating wheels which are spaced apart so that the wheels accelerate the object as it passes between the wheels, without damaging the object, a support for controllably positioning each wheel such that the plane of rotation of each wheel can be tilted about an axis passing through the centers of each pair of wheels, the tilting and rotation of the wheels cooperating to impart a controllable amount and direction of spin to the projected object.

2. A mechanism for projecting non-spherical objects as defined in claim 1, wherein the rotational velocity of the wheels is varied in order to control the amount of spin and velocity imparted to the object.

3. A mechanism for projecting non-spherical objects as defined in claim 1, wherein the guides comprise an upper and lower set of roller guides to inhibit the object from jumping out of the space between the projecting wheels as the object is projected.

4. A mechanism for projecting non-spherical objects as defined in the claim 3 further comprising:

a positioner belt assembly for reorienting the object as it drops from the chute, the belt assembly comprising two rotating belts which symmetrically contact a portion of the object causing it to rotate into the correct position such that the corresponding portion of the object matches the configuration of the positioner on the reciprocating plunger;

5. A device for projecting footballs comprising:

a feed turret having plural containers, each container having a first mechanism for releasably retaining a football in the container, the mechanism comprising a lever which is spring loaded against the football, the lever being connected to a can follower which contacts a cam to controllably release the football;

a chute for receiving the football when the first retaining mechanism releases the football so that it falls into the chute, the chute being located below the containers so that the turret can rotate each container adjacent to the chute, each chute having a second retaining mechanism for controllaby releasing the football, the mechanism comprising at least one holding arm which is resiliently urged against the football, at least one retracting means connected to the holding arm for retracting the holding arm to release the football, and at least one set of rollers on the end of the holding arm in contact with the football to orient the football and facilitate its release from the chute, the football being released with its longitudinal axis in a substantially vertical position;

a linearly reciprocating plunger for transporting the football to a projecting device after the football is released from the chute, the plunger having a positioner which conforms to the shape of that portion of the football in contact with the positioner when the football is correctly positioned;

at least one set of low friction guides for positioning the football as it is fed into the projection device, the guides comprising at least two rollers which provide a low friction contact with the football so as to position the football yet allow it to rotate;

the projection device projects the football and comprises at least one pair of juxtaposed, counter-rotating wheels, which are spaced apart so that the football can be accelerated as it passes between the wheels without damaging the football, a support for controllably positioning each wheel such that the plane of rotation of each wheel can be tilted about an axis passing through the centers of each pair of wheels, the tilting and rotational velocity of the wheels cooperating to impart a controllable amount and direction of spin to the projected football.

6. A device for projecting footballs as defined in claim 5 wherein the guides comprise an upper and lower set of roller guides to inhibit the football from jumping out of the space between the projecting wheels as the football is grasped by the wheels;

and further comprising, a positioner belt means for reorienting the football as it drops from the chute so that the longitudinal axis of the football is in a horizontal position, the positioner means contacting one tip of the football and causing it to lay in a horizontal position, the positioner means being disengaged from contact with the football when no reorientation of the football is desired.

7. A device for projecting footballs as defined in claim 6 further comprising:

hinged guide means for keeping the nose of the football from turning up as the football is reoriented from the vertical to the horizontal position.

* * * * *